United States Patent [19]

Paquin

[11] Patent Number: 4,977,981

[45] Date of Patent: Dec. 18, 1990

[54] WAYSIDE LIFT

[75] Inventor: Gregory J. Paquin, Los Angeles, Calif.

[73] Assignee: Ricon Corporation, Pacoima, Calif.

[21] Appl. No.: 335,331

[22] Filed: Apr. 10, 1989

Related U.S. Application Data

[62] Division of Ser. No. 142,040, Jan. 11, 1988, abandoned.

[51] Int. Cl.[5] ..... B66B 1/00

[52] U.S. Cl. ..... 187/41; 187/105

[58] Field of Search ..... 187/40, 41, 98, 17, 187/1 R, 73, 9 R, 9 E; 414/921, 84, 85, 36; 182/141, 142; 254/89 R, 93 R; 108/144; 248/550, 900

[56] References Cited

U.S. PATENT DOCUMENTS

| | | | |
|---|---|---|---|
| 515,661 | 2/1834 | Day | 187/41 |
| 3,323,661 | 6/1967 | Chaser | 187/41 |
| 4,311,425 | 1/1982 | Pulda | 187/41 |

FOREIGN PATENT DOCUMENTS

| | | | |
|---|---|---|---|
| 1756343 | 4/1970 | Fed. Rep. of Germany | 187/41 |
| 383944 | 3/1908 | France | 187/41 |

*Primary Examiner*—Joseph J. Rolla
*Assistant Examiner*—Kenneth Noland
*Attorney, Agent, or Firm*—Nilsson, Robbins, Dalgarn, Berliner, Carson & Wurst

[57] ABSTRACT

An apparatus for providing access by a handicapped person from a landing to a guideway mounted vehicle includes a support structure having a pedestal portion and a housing extending upward from the pedestal; a lift, mounted in a lift opening of the support structure, includes a platform, linkages interconnecting the platform to the housing, and movement apparatus coupled to selectively move the platform between a lowered position adjacent a landing, a raised position adjacent the top of the pedestal and a vertical storage position in the lift opening; a bridge member pivots between a horizontal position extending into the doorway of a light rail vehicle and a vertical storage position in the passage adjacent the bridge opening; roll-up doors are mounted in the top region of the housing for being slectively rolled down to a position to cover the lift opening and bridge opening when the lift and bridge are in their respective storage positions. A lift disabling mechanism includes a safety plate spaced distance below the platform bottom in non-contacing relationship to platform supports and a plurality of independently responsive switches attached between the safety plate and the platform bottom. Upon movement of the safety plate relative to the platform, the lift motor is disabled by the switches so that movement of the platform immediately stops.

2 Claims, 3 Drawing Sheets

FIG. 2
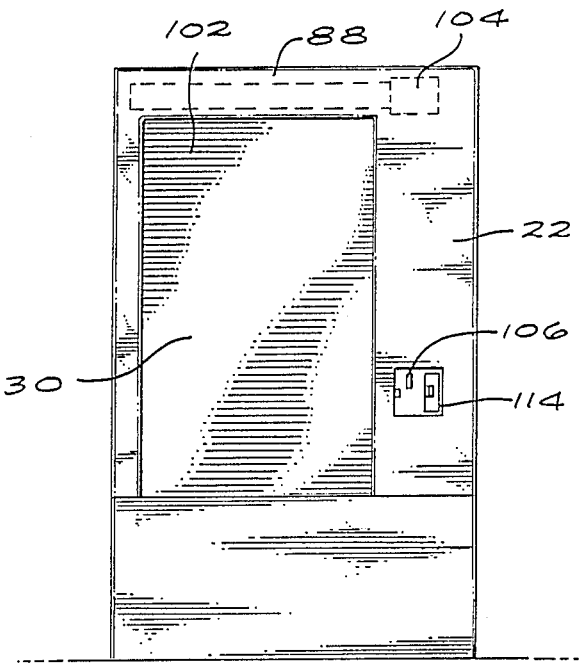
FIG. 3
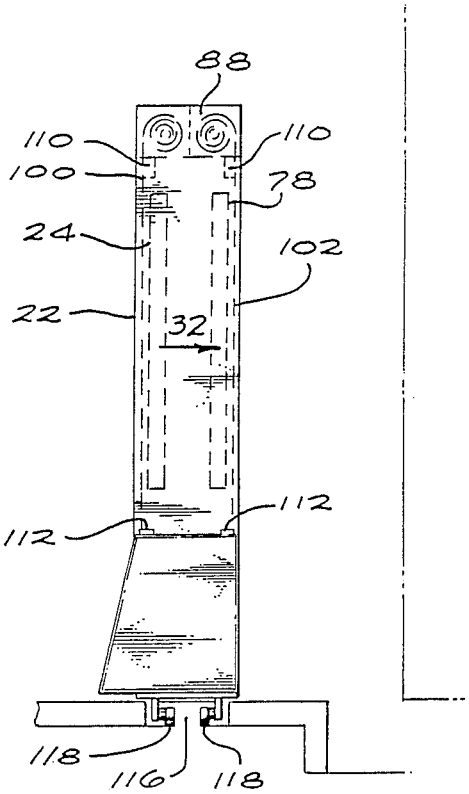
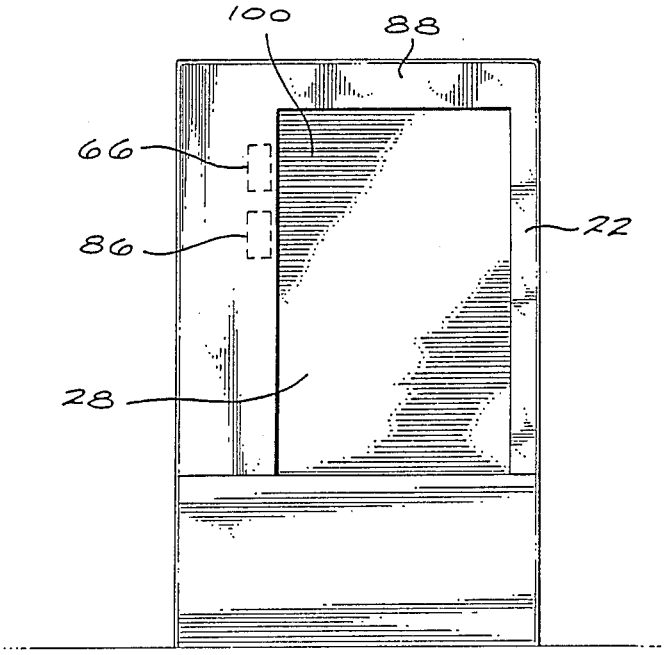
FIG. 4

FIG. 5
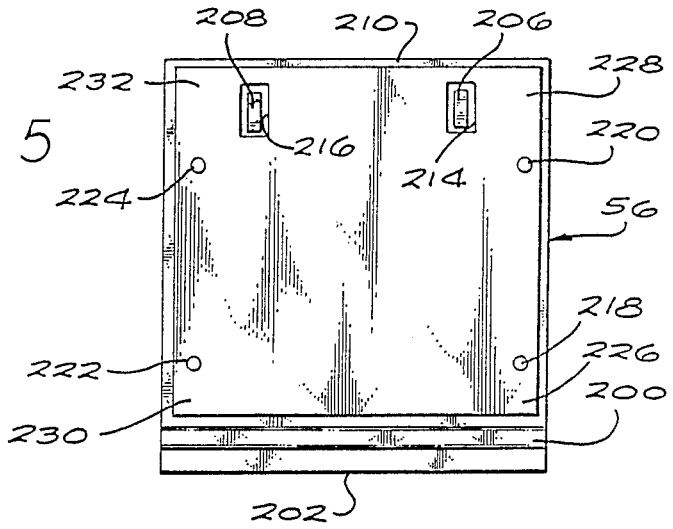
FIG. 6
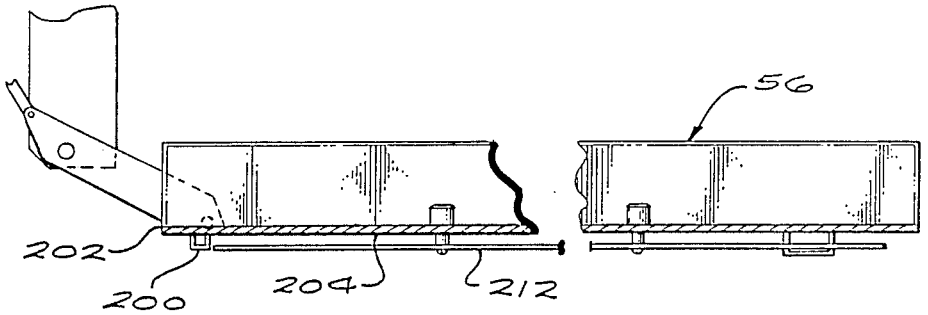
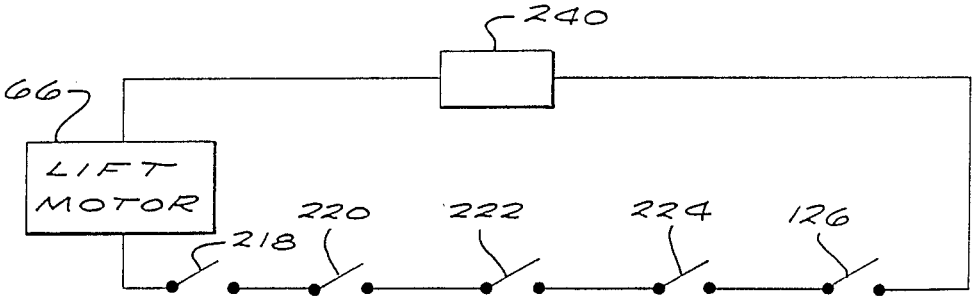
FIG. 7

WAYSIDE LIFT

This is a division, of Application Ser. No. 142,040 filed Jan. 11, 1988 now abandoned.

BACKGROUND OF THE INVENTION

The present invention relates to wheelchair lifts and, in particular, to wheelchair lift apparatus for providing access from a landing to a vehicle.

In recent years, increasing sensitivity to the need to provide for the mobility of handicapped persons has resulted in a proliferation of lift devices for handicapped persons. One type of lift device enabling a handicapped person to use transit facilities is fixed to the landing and includes, as part of a lifting platform, an extendable bridge for providing access from the lifting platform laterally across the threshold to a light rail vehicle. Illustrative of such devices are German Patent No. P3325036.7, dated July 11, 1983; Williams, U.S. Pat. No. 5,576,539, dated Mar. 18, 1986; and Hussey, U.S Pat. No. 4,499 issued Feb. 19, 1985. In such lift devices, the bridge is interconnected to the platform rather than being independently mounted on a separate support structure. Also, such lifts require considerable space on the landing and hence creates a substantial obstruction to the free flow of non handicapped traffic around the lift device.

In order to overcome the obstruction problem which such lifts present, various mobile lifts have been devised which can be moved so they do not obstruct, For example, United Kingdom Patent No. 2,055,344 to Andersson illustrates a mobile lift which must be attached to the vehicle so as to provide the support necessary for the platform as it is being raised. Also, the bridge portion is hinged to the platform and hence raises and lowers with the platform. Kingston U.S. Pat. No. 4,564,096, dated Jan. 14, 1986 similarly shows a movable (transportable) lift which requires mounting or attachment to the rail vehicle to provide the necessary stability lost because of the mobility feature. The necessity to attach the lift to the rail vehicle greatly increases the time necessary to prepare the lift for use and poses significant risks of collapse if the attachment is done incorrectly.

O'Brian et al, U.S. Pat. No. 3,888,463, dated June 10, 1975 illustrates another wheelchair lift which is movable into a position extending at least part way under the vehicle thereby eliminating the need to attach the lift to the rail vehicle. Also, the platform has no bridge member but rather abuts directly against the threshold of the vehicle. Obviously, such an arrangement is not adaptable to a rail vehicle which also has steps. Finally, King Canadian Patent No. 1095462, issued Feb. 10, 1981, shows an apparatus for transferring wheelchair confined passengers between an aircraft and an aircraft tarmac. However, King discloses a bridge member which is necessarily attached to and moves with the platform as it is raised and lowered. Also, King does not provide a support structure as in the present invention.

SUMMARY OF THE INVENTION

The present invention comprises a lift apparatus for providing handicapped access from a landing to a guideway mounted vehicle and includes a support structure with a lift opening on a first side and a bridge opening on a second side opposite to the first side. The support structure includes a pedestal portion which has a top surface providing a connecting passageway and a housing extending upward from the pedestal where the housing has a passageway between the lift opening and the bridge opening A lift device is mounted in the lift opening of the support structure The lift includes a right linkage which has an upper end mounted to the housing alongside the passageway and a left linkage having an upper end mounted to the housing along the other side of the passageway opposite to the one side Both the right linkage and the left linkage have lower ends which are coupled to a platform whereby the platform is capable of pivotal movement about the lower ends of the right and left linkages. A cable or chain is attached on both sides of the platform to prevent pivotal movement of the platform below a generally horizontal position but allow upward pivotal movement into a storage position. A lift movement apparatus is coupled to selectively move the platform between a lowered position adjacent landing and a raised position adjacent the top surface of the pedestal and thereafter to selectively pivot the platform between the raised position and a vertical storage position in the passageway adjacent the lift opening. A bridge apparatus is also mounted to the support structure in the bridge opening. The bridge apparatus includes a bridge member mounted to the support structure for pivoting between a vertically stored position and a generally horizontal position for extending into the doorway of a light rail vehicle to provide access from the top surface of the pedestal along the bridge to the guideway mounted vehicle. Bridge actuation apparatus is coupled for selectively moving the bridge between the horizontal position and the bridge storage position. Finally, bridge control switches are provided for enabling the bridge actuation apparatus and lift control switches are provided for selectively actuating the lift actuating apparatus.

The present invention may also optionally include a first roll-up door which is mounted in the top region of the housing for being selectively rolled down to a position to cover the lift opening when the lift is in the lift storage position. Also, a second roll-up door is mounted in the top region of the housing for being selectively rolled down to a position covering the bridge opening when the bridge is in the bridge storage position. Motors are provided to effect movement of the first and second roll-up doors with a door control switch provided to selectively actuate the motors.

In yet another embodiment of the invention, the lift apparatus includes a lift disabling mechanism which includes a plurality of platform supports extending a first distance from the bottom of the platform at isolated spaced locations along the bottom of the platform for contacting the landing and supporting the platform against the landing when the platform is in the lowered position. A safety plate is provided a spaced distance below the platform bottom to cover a substantial portion of the surface area of the platform bottom but in non-contacting relationship to the platform supports. The distance the safety plate is spaced below the platform is less than the distance the platform supports extend from the bottom of the platform. Finally, a plurality of switches are attached to the safety plate where each switch is independently responsive to movement of the safety plate toward the platform bottom. Upon such movement, each switch is independently, electrically coupled to disable the lift motor so that movement of the platform immediately stops upon contact with the safety plate.

BRIEF DESCRIPTION OF THE DRAWINGS

A complete understanding of the present invention and of the above and other advantages may be gained from a consideration of the following description of the preferred embodiments taken into conjunction with the accompanying drawings in which:

FIG. 2 is a back view of the lift apparatus as viewed from the trackway;

FIG. 3 is a side view illustrating the roll-up doors in accordance with the invention;

FIG. 4 is a front view of the lift apparatus;

FIG. 5 is a bottom view of the safety plate apparatus on the bottom of the platform in accordance with the invention;

FIG. 6 is a side view of the lift platform showing additional features of the safety plate apparatus; and FIG. 7 is a simplified schematic showing one embodiment of the connection of the switches coupled to the safety plate and the motor.

DETAILED DESCRIPTION

Figure 1:
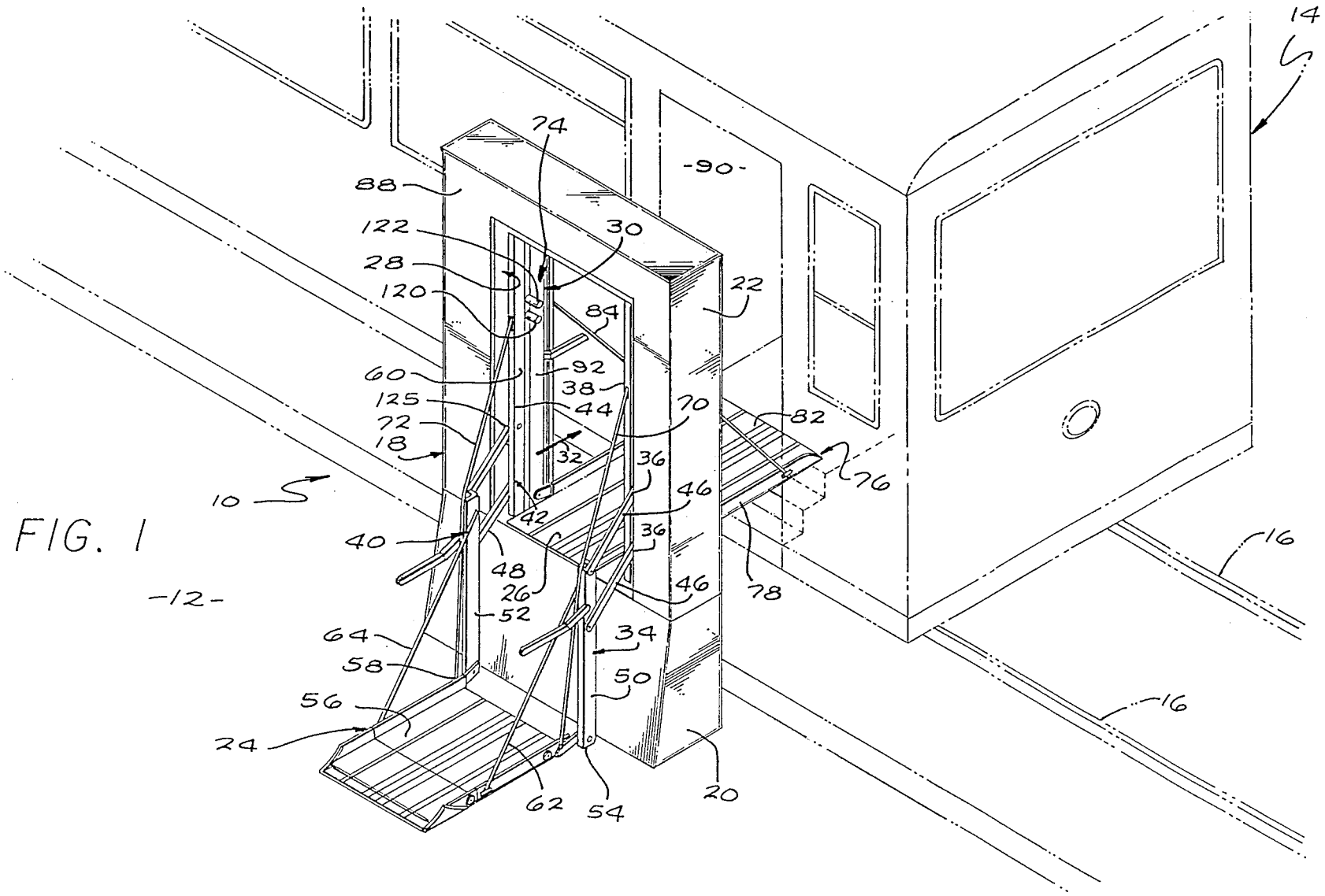
FIG. 1 is a pictorial view of a lift in accordance with the invention.

Referring initially to FIG. 1, a lift apparatus 10 for providing handicap access from a landing 12 to a vehicle 14, such as a conventional light rail vehicle which moves along trackway 16, includes a support structure 18 consisting of a pedestal 20 and a housing 22. The pedestal 20 may be either permanently fixed to the landing 12 at a predefined distance from and in alignment with the trackway 16 or may be movably mounted in a manner to be described hereafter. The pedestal 20 has a top surface 26 and is preferably made of a heavy material such as concrete to provide a counterbalancing weight to a lift assembly 24. The housing 22 extends upward from the top surface 26 of the pedestal 20 and defines a lift opening 28 on the side of the lift apparatus 10 remote from the trackway and a bridge opening 30 on the other side of the lift apparatus 10 nearest the trackway 16. A passageway 32 extends through the housing 22 between the lift opening 28 and the bridge opening 30. The top surface 26 of the pedestal provides a connecting rampway between the lift opening 28 and the bridge opening 30.

The lift 24 is mounted in the lift opening 28 of the housing 22 and includes a right linkage 34 having an upper end 36 pivotally connected to one side of 38 of the passageway 32. The lift further includes a left linkage 40 which has an upper end 42 similarly connected to the other side 44 of the passageway 32. In the preferred embodiment, the right linkage 34 includes a pair of parallel links 46 connected to a right post 50 and the left linkage 40 includes a pair of parallel links 48 connected to a left post 52. The right post 50 has a lower end 54 which is connected to two one corner of a platform 56. The left post 52 similarly has a lower end 58 pivotally connected to an opposite corner of the platform 56.

The housing 22 also preferably includes a support frame 60 positioned to surround the passageway 32 adjacent the lift opening and to which the right linkage 34 and the left linkage 40 are pivotally attached. In order to prevent the platform 56 from pivoting below a horizontal orientation, a right cable 62 is interconnected between the right post 50 and the platform 56 and a left cable 64 is interconnected between the left post 52 and the platform 56.

Turning to FIG. 4 in connection with FIG. 1, a lift movement means includes a lift motor 66 interconnected to lift chains 70 and 72 which extend over suitable sprockets (not shown), through orifices in the support frame 60, over the top of the posts 50 and 52 to interconnect to the platform 56 adjacent to but spaced slightly outwardly from the lower ends 54 and 58 of the posts 50 and 52 respectively. Thus, when the motor 66 is operated, the chains 62 and 64 either wind or unwind on the sprockets to cause the platform 56 to move between a lowered position adjacent the landing 12 and an upper position which is an extension of the top surface 26 and thereafter to cause the platform to pivot from a horizontal orientation in the upper position to a vertical orientation within the lift opening 28 thereby defining a storage position for the lift 24 when the lift is not in use.

L

One lift device which is particularly adaptable to the present invention is set forth greater detail in U.S Pat. No. Re 31,178, which patent is hereby incorporated by reference.

Finally, the lift 24 includes lift control means 74 for manually causing the platform move between its lowered and its raised positions and further to pivot into the storage position.

In order to provide access from the platform 56 into the guideway mounted vehicle 14, the lift apparatus 10 further includes bridge means 76 mounted in the bridge opening 30 of the housing 22. The bridge means includes a bridge member 78 which is pivotally interconnected to the housing 22 on each side of the passageway 32. The bridge means 76 further includes bridge movement means which, as illustrated, includes a right bridge lifting cable 82 and a left bridge lifting cable 84 interconnected by conventional sprockets and other mechanical linkages (not shown) to a bridge motor (FIG. 4).

Turning to FIGS. 2, 3 and 4, the present invention further includes a first roll-up door 100 mounted in a top region 88 of the housing 22 which may be selectively rolled down to cover the lift opening 28 when the lift 24 is in the vertical storage position within the passageway 32. Similarly, a second roll-up door 102 is mounted in the top region 88 of the housing 22 for being rolled down to cover the bridge opening 30 when the bridge member 78 is pivoted into a vertical position within the passageway 32 of the housing 22. Coupled to cause the first and second roll-up doors 100 and 102 to either cover or uncover the lift opening 28 and bridge opening 30 is a roll-up door movement means or motor 104 interconnected in a conventional manner (not illustrated) to the first and second roll up doors. Electrically coupled to the motor 104 is a door control switch 106. In the preferred embodiment, when the switch 106 is actuated, both the first roll-up door 100 and the second roll-up door 102 are operated simultaneously by the motor means 104. This may be accomplished by suitable gearing of a single motor or by simultaneous electrical actuation of two motors, each connected to one of the first or second roll-up doors 100 or 102. Suitable roll-up doors and their associated control mechanisms are well known and may, for example, be those manufactured and sold under the trademark Alulux.

In order to prevent operation of either the lift 24 or the bridge 76 while the roll-up doors are in the covered or closed position, an interlock means consisting of limit switches 110 mounted at an upper location of the housing 22 and limit switch actuators 112 mounted to the bottom of at least one of the roll-up doors may also be incorporated. The limit switches are positioned so that as the roll-up doors are extended, the limit switch actuators 112 contact the limit switches 110 which may, for example, be coupled in series with both the lift motor 66 and the bridge motor 86, to open the circuit between the motor and their power supplies thereby disabling operation of both motors 66 and 86. When the door is subsequently retracted, the roll-up door switch actuators 112 again contact the switches 110, closing those switches and allowing current to flow from the power supply to the motors 86 and 66. Of course, alternative means of disabling motors 86 and 66 may be incorporated without departing from the present invention.

The present invention further includes bridge control means 114 consisting of a switch which is coupled to actuate the bridge motor 86 to cause the right and left bridge lifting cables 82 and 84 to either extend or retract thereby pivoting the bridge member 78 either from a storage position to a lowered position extending across the light rail vehicle threshold into the door 90 of the light rail vehicle or pivot upward into a storage position in the bridge opening 30.

Referring momentarily to FIG. 1, in the preferred embodiment the bridge member 78 is pivotally mounted to a support structure 92 which is part of the housing 22 and which extends around the bridge opening 30.

In one embodiment the pedestal 20 is permanently and rigidly affixed to the landing 12. In such an embodiment, it is necessary for the driver of the railed vehicle 14 to align the door of the vehicle 14 with the lift apparatus 10 so that the bridge member 78, when lowered, will extend into a doorway of the railed vehicle. Referring to FIG. 3, the pedestal 20 could alternatively be movably mounted on the landing 12 by providing a suitable track 116 in the landing 12 with suitable wheels or rollers 118 extending from the pedestal 20 to interlock with the track means 116 so that the pedestal is movable along the track means 116 preferably parallel to the trackway 16.

In operation, the lift apparatus 10 on the landing 12 will, prior to use, have the lift 24 folded in a storage position in the passageway 32 and the bridge means 76 likewise folded in a storage position in the passageway 32 with both roll-up doors 100 and 102 in a closed position over the lift opening 28 and bridge opening 30, respectively The rail mounted vehicle which either is to take on or discharge a handicapped person, will approach the lift apparatus 10 aligning one of its doors with the passageway 32 The conductor or other assistant from the railed vehicle will disembark from the door 90 and will actuate the door control switch 106 to raise the first and second roll-up doors 100 and 102 by actuation of the roll-up door movement means 104. When the roll-up doors reach their full opened state, the switch actuator 112 will trip the limit switch 110 enabling operation of the lift motor 66 and the bridge motor 86. The conductor will next actuate the bridge control means 114 which will turn on the bridge motor 86 to lower the bridge member 78 from its stored position to a generally horizontal position extending into the door 90 of the rail mounted vehicle. Once the bridge member 78 is so extended into the doorway 90, the conductor will again mount the vehicle 14 and enter the passageway 32 to operate the lift control means 74.

In the preferred embodiment, the lift control means 74 includes a first manually operated switch 120 and a third manually operated switch 122. Initially, the operator depresses the third manually operated switch 122 which causes the lift apparatus to unfold from a storage position into a horizontal but raised position adjacent the top surface 26 of the pedestal 20. The operator then depresses the first manually operated switch 120 to cause the platform 56 to lower to the landing 12 and assume its lowered position. At that point, a handicapped person in a wheelchair can mount the platform 56 whereupon the lift operator again deflects the first manually operated switch 120 to cause the platform 56 to rise to the upper position adjacent to the top surface 26 whereupon the handicapped person rolls across the top surface 26 onto the bridge and into the vehicle 14. The operator then reverses the above process to again return the lift and bridge to the stored position and lower the first and second roll-up doors 100 and 102.

In one embodiment, a second switch 125 which may be a normally toggle switch may be suitable positioned, for example on the support frame 60, so that when the lift reaches either its lowered or its raised position, the linkage 48 will contact the switch 125 to turn off the lift motor 66. Of course, the switch 125 may be position at any suitable location and is preferably positioned in a protected location.

Turning to FIGS. 5 and 6, an additional detail of the platform 56 is illustrated whereby if a foreign object is inadvertently located underneath the lift platform a safety mechanism will automatically turn off the lift motor when the platform bottom touches the object and hence prevent further movement of the platform until the object between the landing and platform can be removed. This essential safety feature is to prevent the lift from being lowered onto an object which could well be a person To provide such a lift disabling apparatus, the platform in accordance with the present invention includes a support bar 200 extending across the width of the platform at a rear region 202 nearest the pedestal 20 The support bar 200 preferably extends approximately one inch below the bottom surface 204 of the platform 56. Also included are a right front support post 206 and a left front support post 208 which likewise extend approximately one inch from the bottom 204 of the platform 56. The right front support post and left front support post 206 and 208 are positioned near the front region 210 of the platform 56 which is opposite the rear region 202 A safety plate 212 is then provided to cover substantially the entire bottom surface 204 of the platform 56 with the right front support post 206 extending through a right opening 214 in the safety plate 212 and the left front support post 208 extending through a left opening 216 in the safety plate 212. The safety plate 212 is spaced a distance from the platform bottom 204 which is smaller than the distance which the left front support post 208, right front support post 206 and rear support bar 200 extend from the bottom 204 of the platform 56. Hence, the right front support post 206, left front support post 208 and support bar 200 will contact a flat surface such as the landing 12 before the safety plate 212 will contact such landing and hence the safety 212 will not be pressed upward toward the platform 56. In the preferred embodiment, the safety plate 212 is interconnected by four normally closed switches 218, 220, 222 and 224. The switches are mounted to the platform 56 and extend to and are attached to the safety plate 212. In the illustrated embodiment the first switch 218 interconnects and spaces the safety plate 212 a predefined distance from a first corner region 226 of the platform. The second switch 220 is similarly interconnected between the safety plate and the platform at a second corner region 228 adjacent the right front support post 206. The third switch 222 is positioned between the platform and the safety plate at a third corner region 230 adjacent the rear support bar 200 and the fourth switch 224 is mounted between the safety plate 212 and the platform adjacent a fourth corner region 232 adjacent the left front support post 208.

Referring to the simplified representative electrical circuit schematic of FIG. 7, when the platform 56 is lowered in response to actuation of the first manually operable switch 120 (switch 125 is normally closed) and there is an object on the landing underneath the platform, that object will come in contact first with the safety plate 212 in almost all instances. Contact with the safety plate 212 while the platform is still lowering, will cause one or more of the switches 218, 220, 222 and 224 to be opened. As set forth in FIG. 7, the switches may be functionally interconnected in series to the lift motor 66 and are all in a normally closed relationship allowing power from the power supply 240 to operate the lift motor 66. However, when the safety plate is depressed and one of the switches 218, 220, 222 or 224 is depressed then that switch will open and thereby disconnect the power 240 from the motor 66 and immediately causing the platform to stop downward movement.

Of course, various means of electrically interconnecting the switches to operate the lift, bridge and roll up doors are possible and well known to those skilled in the art and have therefore not been described in detail. Also various other embodiments are possible without departing from the present invention as set forth in the claims.

What is claimed is:

1. A lift disabling device for a lift apparatus having a platform for supporting an object, the platform having a bottom, the lift having a lift movement means for moving the platform between a lowered position adjacent a landing and a raised position, the lift disabling device comprising:

a plurality of platform supports extending a first distance from the bottom of the platform at isolated spaced locations for contacting the landing and supporting the platform against the landing when the platform is in the lowered position;

a safety plate spaced a second distance below the platform bottom and positioned to cover a substantial portion of the surface area of the platform bottom but in non-contacting relationship to the platform supports, the first distance being greater than the second distance so that the platform supports prevent the safety plate from contacting the landing when the platform is in the lowered position;

a plurality of switch means mounted to the bottom of the platform and attached to the safety plate, each switch means being responsive to movement of the safety plate toward the platform bottom, each switch means electrically coupled for disabling the lift movement means when the switch means is electrically switched in response to movement of the safety plate toward the platform bottom;

the platform further having a front region and a rear region, the plurality of platform supports comprising:

a support bar extending across the width of the platform bottom at the rear region of the platform;

a right front support post protruding from the platform bottom at a right location in the front region; and a left front support post protruding from the platform bottom at a left location in the front region;

the safety plate having a right opening and a left opening therethrough aligned with the right and left front support posts so that the right and left front support posts extend through the right and left openings in the safety plate.

2. The lift disabling device of claim 1 wherein the safety plate has four corner regions and one switch means is positioned at each corner region.

* * * * *